United States Patent [19]

Hosogaya

[11] 4,403,878

[45] Sep. 13, 1983

[54] PAPER-FEEDING MECHANISM OF A SMALL-SIZED PRINTER

[75] Inventor: Hiroshi Hosogaya, Shiojiri, Japan

[73] Assignee: Epson Corporation, Shiojiri, Japan

[21] Appl. No.: 240,450

[22] Filed: Mar. 4, 1981

Related U.S. Application Data

[63] Continuation of Ser. No. 11,722, Feb. 12, 1979, abandoned.

[30] Foreign Application Priority Data

Feb. 10, 1978 [JP] Japan ..... 53-14598

[51] Int. Cl.[3] ..... B41J 11/48; B41J 11/50

[52] U.S. Cl. ..... 400/585; 400/605; 400/608.4; 226/109

[58] Field of Search ..... 400/584–588, 400/583–584, 605–607, 607.3, 608.1, 608.4; 226/109–110; 101/279, 228; 74/321, 340, 437

[56] References Cited

U.S. PATENT DOCUMENTS

| | | | |
|---|---|---|---|
| 1,421,213 | 6/1922 | Goodwin | 74/321 |
| 1,696,243 | 12/1928 | Kurowski | 400/585 |
| 2,653,690 | 9/1953 | Saracchi | 74/340 |
| 3,653,483 | 4/1972 | Cortona | 400/585 X |
| 3,918,313 | 11/1975 | Montagnino | 74/437 |
| 4,027,765 | 6/1977 | Crump | 400/588 X |
| 4,109,843 | 8/1978 | Usui | 226/109 |

*Primary Examiner*—A. J. Heinz

*Attorney, Agent, or Firm*—Blum, Kaplan, Friedman, Silberman & Beran

[57] ABSTRACT

In a small printer a common drive mechanism advances two independent paper sheets in unison by a single line spacing or pitch distance during each print cycle. Alternatively the first paper sheet is advanced four pitch distances while the second sheet is advanced one spacing or pitch distance during a print cycle. Or in another alternative action only the second paper sheet is advanced one pitch distance in the print cycle while the first sheet is stationary. Gearing to drive each paper sheet is coaxially but independently mounted. A solenoid plunger translates the gearing which drives the first sheet between a position of engagement with the gears driving the second sheet, and a position of engagement with intermediate gearing which drives the first paper sheet by four spacings.

4 Claims, 2 Drawing Figures

PAPER-FEEDING MECHANISM OF A SMALL-SIZED PRINTER

This is a continuation of application Ser. No. 11,722, filed Feb. 12, 1979, now abandoned.

BACKGROUND OF THE INVENTION

This invention relates generally to small-sized or miniaturized paper printers and more particularly to printers where two independent sheets of paper are used for printing. In a conventional small-sized printer of the prior art wherein one printing operation is performed in a single printing cycle, advancement or feeding of the printing paper is normally performed so as to feed a predetermined length, for example, one pitch distance or spacing in one printing cycle, pitch distance being, for example, the spacing between two adjacent printed lines. When, in the prior art it has been desired to feed the printing paper by several pitch distances, for example, five spaces, feeding of the printing paper by five pitch distances is accomplished by repeating the same printing cycle five times. In such a conventional prior art small-sized printer, it is possible to provide paper feeding of only one pitch distance in one printing cycle. It has heretofore been impossible to provide fast feeding wherein several pitch increments are advanced in a single printing cycle. Furthermore, small-sized printers used for printing two sheets, as is common in a cash register, and the like, has several deficiencies such as the unnecessary feeding of both paper sheets even when it is only necessary that one printing paper be fed, since two strips of paper are simultaneously fed by the mechanism in normal operation.

What is needed is a printer for two sheets of paper which allows for the advancement of one sheet without the advancement of the other during each print cycle, or in the alternative allows the advancement of both sheets equally during each print cycle, or in a further alternative allows the rapid advancement of one sheet while the other sheet advances normally in each print cycle.

SUMMARY OF THE INVENTION

Generally speaking, in accordance with the invention, a paper feeding mechanism for a small-sized printer especially suitable for printing on two sheets of paper is provided. This paper feeder of this invention has a common drive mechanism which advances two independent paper sheets in unison by a single line spacing or pitch distance during each print cycle. Alternatively, the first paper sheet is advanced four pitch distances while the second sheet is advanced one pitch distance or line spacing during a print cycle. Or in another alternative action, only the second paper sheet is advanced one pitch distance in the print cycle while the first sheet is stationary. Gearing to drive each paper sheet is coaxially but independently mounted. A solenoid plunger translates the gearing which drives the first sheet between a position of engagement with the gears driving the second sheet, and a position of engagement with intermediate gearing which drives the first paper sheet by four spacings in a single print cycle.

Accordingly, it is an object of this invention to provide a paper feeding mechanism in small-sized printer having two paper strips advancing from a common drive.

Another object of this invention is to provide a paper-feeding mechanism in a small-sized printer wherein a plurality of tapes are advanced in unison or at different feed rates.

A further object of this invention is to provide a paper-feeding mechanism in a small-sized printer having two paper sheets wherein one sheet may be advanced for printing while the other remains stationary.

Still another object of this invention is to provide a paper-feeding mechanism in a small-sized printer which is simple in construction.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
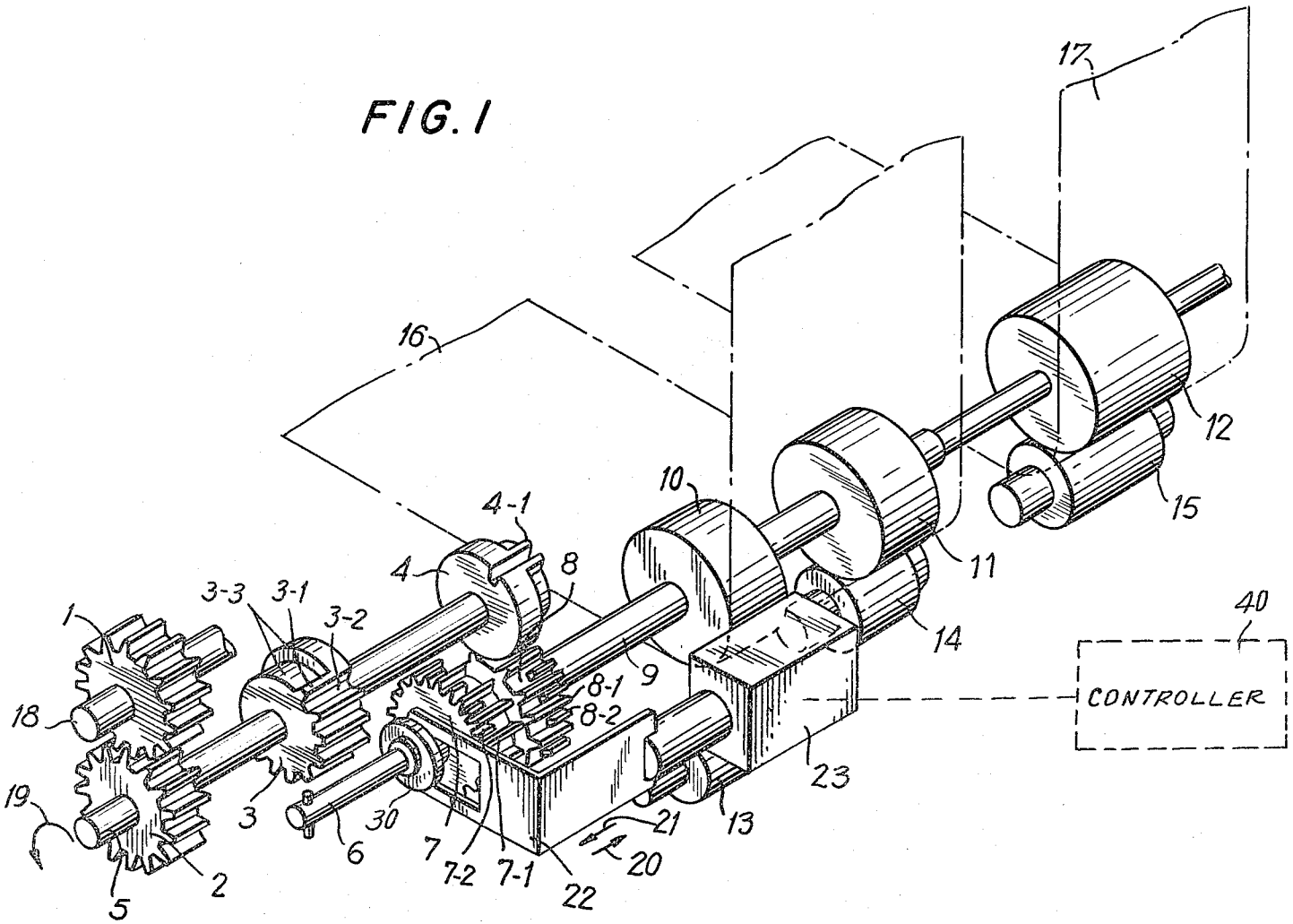
FIG. 1 is a perspective view of the paper-feeding mechanism of this invention.

With reference to the figures, the gear 1, which is rotated by external means (not shown) is attached to the driving axle 18 and rotates therewith by one revolution per one printing cycle. The gear wheel 2 fixedly attached on the shaft 5 engages with the gear 1 and rotates by one revolution per printing cycle, that is, there is a 1 to 1 gear ratio between gears 1 and 2. The second driving gear 4 is also fixedly attached to the shaft 5 and rotates therewith. The driving gear 4 has two teeth 4-1 which upon rotation engage a single tooth on the gear 8, and rotate the gear 8 by an angular amount corresponding to one line of print for one printing cycle. Also the first driving gear 3 is fixedly attached for rotation with the shaft 5. Accordingly three gears 2, 3, 4, rotate in unison on the shaft 5 by one revolution for each printing cycle of the printer (not shown).

The printer of this invention includes two paper sheets 16, 17. In the example which illustrates this embodiment, one paper sheet 16 provides for the printing of a journal ledger thereon whereas the other sheet of paper 17 is used in printing a receipt as would be given to a customer if this printer were used in a cash register. In this description which follows several components are identified with terms referring to either the journal paper or the receipt paper.

The journal paper feed gear 8 is fixedly attached on the paper feed roller shaft 9 associated with the journal paper 16. The paper feed roller 10 is mounted coaxially with the paper feed roller shaft 9 but is not directly fixed thereto. The paper feed roller 11 is fixedly attached to the paper feed roller shaft 9 and rotates therewith. The shaft 6 is coaxial with the shaft 9 and rotates freely within the shaft 9. The receipt paper feed gear 7 is mounted for rotation on shaft 6 and also slides longitudinally along the shaft 6 as described hereinafter.

The paper feed roller 12 is fixedly supported for rotation with the shaft 6. The paper pressing roller 13 oppositely faces the paper feed roller 10. The paper pressing roller 14 is oppositely facing the paper feed roller 11 and the paper pressing roller 15 is oppositely facing the paper feed roller 12. The journal printing paper 16 is fed by engagement of the paper feed roller 11 with the paper pressing roller 14 with the paper 16 sandwiched between the rollers 11,14 in the conventional manner. The receipt printing paper 17 is fed by engagement of the paper feed roller 12 with the paper pressing roller 15 with the paper 17 therebetween.

A driving method for driving a paper feed roller, namely a driving method for feeding the paper by an amount corresponding to one pitch distance from a shaft operated for one rotation during one printing cycle has been described in detail in Japanese Patent Application No. 37,555/1976. A driving system which enables paper feeding of more than one pitch increment in one printing cycle is described below. The mechanism of this invention feeds paper for both one pitch distance and for four pitch distances in a single printing cycle.

FIG. 1 shows the operating mode wherein the paper is fed by an amount corresponding to one pitch distance or space between the printed lines in one printing cycle. The driving gear 3 has eight teeth 3-1 and seven recesses 3-2 formed between the teeth 3-1. These teeth 3-1 extend only partially around the hub of the gear 3. On the shaft 6 of the paper feed roller 12 is fixed the receipt paper feed gear 7 which releasably engages with the first driving gear 3 as described below. The receipt paper feed gear 7 has wide teeth 7-1 alternating with the narrower teeth 7-2 which are recessed to about half of the length of the teeth 7-1.

The changeover lever 22 is connected to the plunger 23 at one end and to the collar 30, which is an integral part of the gear 7, at the other end. Thus when the plunger 23 translates in the directions indicated by the arrows 20, 21, the gear 7 will similarly translate sliding along the shaft 6. The plunger 23 is driven by a solenoid winding not shown in the drawings. When the plunger 23 is not energized, the changeover lever 22 moves the receipt paper feed gear 7 in the direction of the arrow 20 and moves the receipt paper feed gear 7 to a position proximate the second driving gear 4 as shown in FIG. 1. In this mode, the receipt paper feed gear 7 is integrally connected with the journal paper feed gear 8 and rotates in unison therewith because of engagement of the lateral projections 24 (FIG. 2) extended from the receipt paper feed gear 7, with the recesses 25 provided in the side face of the journal paper feed gear 8. Now when the gear 4 rotates one revolution as it will during one print cycle of the printer, the gear 8 and the connected gear 7 rotate a distance which moves both printing papers 16, 17 by a distance which provides the proper space between consecutively printed lines on the paper.

Figure 2:
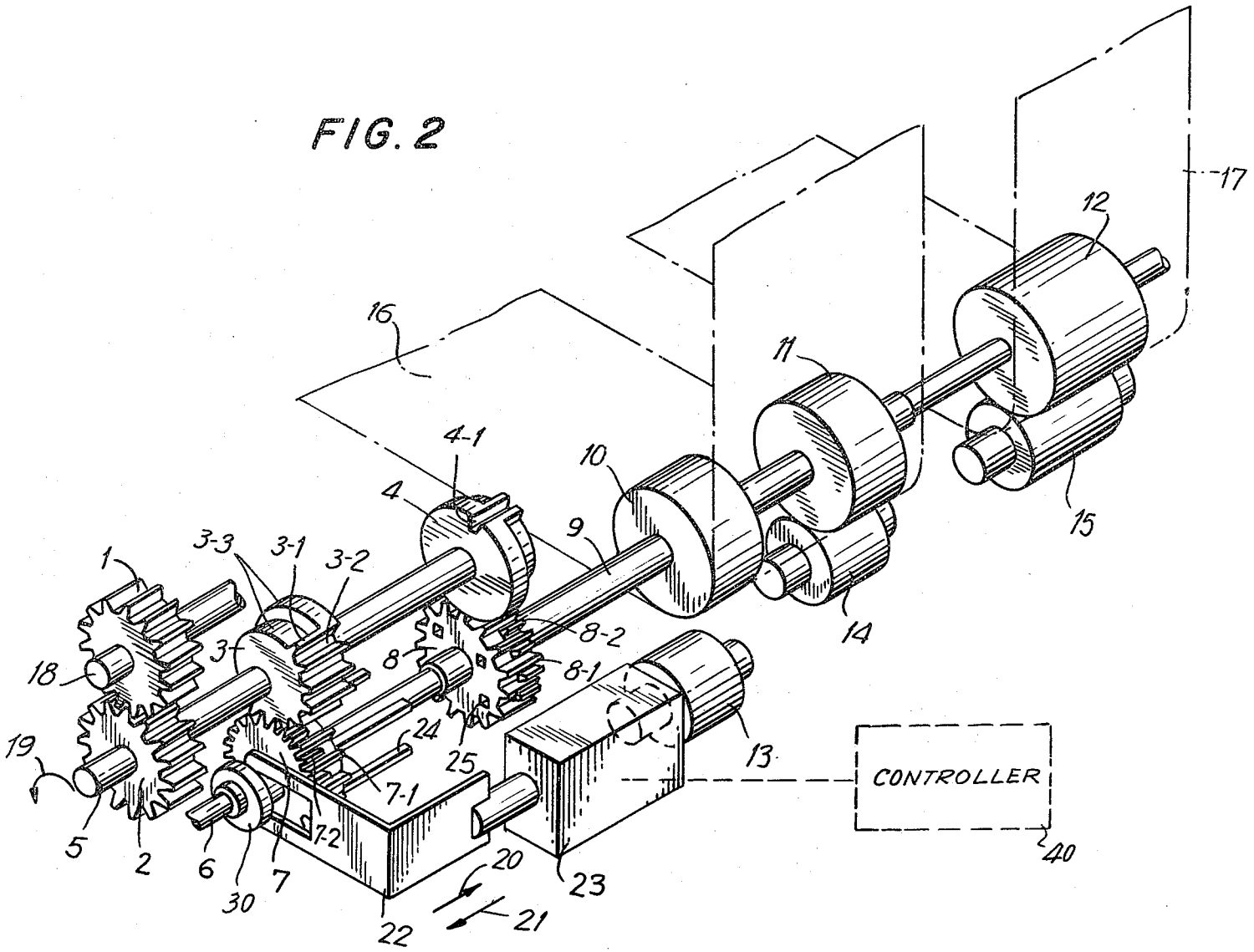
FIG. 2 is a perspective view of the paper-feeding mechanism of FIG. 1 in an alternative mode of operation.

For fast feeding of the receipt printing paper 17, the plunger 23, at a particular moment in the print cycle, is energized and as shown in FIG. 2, the changeover lever 22 is moved in the direction of the arrow 21 whereby the receipt paper feed gear 7 engages with the toothed portion of the first driving gear 3. The relationship between gears 4 and 8 remains unchanged, however gear 7 becomes entirely disengaged from gear 8 and each is free to rotate with its respective shaft. The driving shaft 5 is rotated in the direction of the arrow 19 and the first driving gear 3 affixed to the shaft 5 is also rotated in the same direction as that of the driving shaft 5. When the teeth of the first driving gear 3 and the teeth of the receipt paper feed gear 7 are engaged with each other (FIG. 2), the receipt paper feed roller shaft 6 and the paper feed roller 12 affixed for rotation with the paper feed roller shaft 6, rotate. This provides an angular rotation equivalent to four pitch increments and causes feeding of the receipt paper 17 by four pitch increments or line spacings in one printing cycle. When the plunger 23 is de-energized after the paper feeding of four pitch increments in completed, the changeover lever 22 moves in the direction of the arrow 20 along with the receipt paper feed gear 7. Thus the paper feeding mechanism is returned again to the operating mode where both papers 16, 17 are advanced by one spacing distance in each print cycle.

Thus, the plunger 23 is energized or de-energized in one printing cycle and the receipt paper feed gear 7 is moved by the changeover lever 22. Thereby, it is possible to provide a feeding of the receipt printing paper 17 and the journal printing paper 16 by a one-step increment, or the feeding of the receipt printing paper 17 can be accomplished in a four-step increment while concurrently the journal paper 16 is advanced by only one pitch increment. In this example, the feeding of the journal printing paper 16, always by a one-pitch increment, is accomplished so that the journal paper feed gear 8 is always kept in the rotational path of the teeth 4-1 of the second driving gear 4. However, it is the same driving source operating through gear 1 which is used for feeding the paper for the one-space incremental distance and for the four-space incremental distance. Paper feeding of one-pitch distance is performed so that the power force is transmitted from the gear 1, supported on the driving axis 18, to the gear 2. The rotational force is then transmitted to the second driving gear 4, supported coaxially with the gear 2, and is then transmitted to the receipt paper feed gear 7 and to the journal paper feed gear 8 when the plunger 23 is de-energized. Feeding of the receipt paper 17 by a four-space distance is performed such that the driving force is transmitted from the gear 1 to gear 2 and the rotation is transmitted to the first driving gear 3, coaxially supported with the gear 2. The plunger 23 is energized to move the receipt paper feed gear 7 in the direction of the arrow 21 along with the changeover lever which moves the gear 7. Thereby the power of the first driving gear 3 is transmitted to the shaft 6 via gear 7 and the receipt printing paper 17 is fed at the accelerated rate.

When it is desired to terminate or omit the feeding of the receipt printing paper 17, the operation of the mechanism is precisely the same as that for the performance of a four-pitch distance movement of the receipt paper 17 except for the timing in the cycle when the plunger 23 is energized. For moving the receipt paper 17 by four spaces, the plunger 23 is energized, as described above, at a time in the printing cycle so that the translating gear teeth 7-1, 7-2 of gear 7 engage with the gear teeth 3-1, 3-2 on the rotating gear 3. Thereby motion is given to the shaft 6 and the roller 12. However, to omit advancement of the receipt paper 17, the plunger 23 is energized before the second driving gear 4 has engaged with the journal paper feed gear 8 and at a time in the print cycle so that the non-toothed portion 3-3 of the first driving gear 3 opposes the teeth on the receipt paper feed gear 7. Although the first driving gear 3 continues to rotate with the shaft 5, the receipt paper feed gear 7, not engaged to the teeth of gear 3, does not rotate. The plunger 23 is not de-energized until after engagement between the second driving gear 4 and the journal paper feed gear 8 is terminated. Thus, the journal paper 16 advances by one space as described above. The plunger 23 is de-energized before the teeth on the gear 3 and the teeth on the gear 7 have engaged. Thus, the plunger 23 is energized with timing to avoid rotation of the gear 7 either through the action of gear 4 or gear 3. Accordingly for that particular print cycle the receipt paper is not advanced. However, the mechanism is ready for the next print cycle when it can advance the receipt paper at a normal single space rate or an accelerated four-space rate in a print cycle. The device in which the printer is incorporated, for example, a cash register, determines what the actual mode of operation will be for each cycle of printing.

In brief, according to this invention, the paper feed roller 11 enables a paper feeding of one pitch spacing for the journal paper 16 in one print cycle. The paper feed roller 12 enables a feeding for the receipt paper 17 of either one pitch spacing or four pitch spacings in one printing cycle by engaging or disengaging the receipt paper feed gear 7, with proper timing of motion in the direction of arrows 20, 21, using the outer changeover means, i.e., the plunger 23 and changeover lever 22.

Actuation and timing of the plunger 23 is directed by the controller 40 which translates the receipt paper gear 7 between its two lateral positions in accordance with the printing operation which is performed. For example, ledger journal and receipts are printed and fed simultaneously, or only the ledger journal is printed and fed, or the ledger journal and receipt are printed simultaneously and then the receipt paper is rapidly advanced by an extended distance so the receipt may be separated as in a cash register from the remainder of the paper and presented to a customer.

It should be noted that because of the asymetric arrangement of teeth on the first and second drive gears 3, 4, the paper sheets 16, 17 remain stationary for printing for substantially the entire print cycle, and feeding of the paper or papers occurs rapidly over a small portion of the print cycle.

While the invention has been described above in terms of one pitch spacing and four-pitch spacings, it should be obvious that these numbers have been selected for the sake of an example, and the scope of this invention is not limited to those particular motions in advancing the two printing papers.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

I claim:

1. A paper-feeding mechanism for a small sized printer, having at least two paper sheets for printing thereon, comprising:

a first roller for frictional engagement with a first paper sheet, rotation of said first roller causing said first paper sheet to feed, said first roller being attached to a first shaft for rotation therewith;

a second roller for frictional engagement with a second paper sheet, rotation of said second roller causing said second paper sheet to feed, said second roller being attached to a second shaft for rotation therewith, said first shaft and said second shaft being coaxial;

a first gear attached to and rotating with said first shaft;

a second gear attached to and rotating with said second shaft;

a third gear, said third gear being adapted to selectively engage and drive either said first gear or said first and second gears in unison, and having teeth on only a minor portion of the circumference thereof, engagement between said first and third gears occurs only during a small angle of rotation of said third gear, and said paper sheets are stationary for printing thereon for substantially the entire rotation of said third gear;

a fourth gear, said fourth gear having teeth on only a minor portion of the circumference thereof, when said second and fourth gears are aligned, engagement between said second and fourth gears occurs only during a small angle of rotation of said fourth gear, and said second paper sheet remains stationary for printing thereon for substantially the entire rotation of said fourth gear;

means for rotating said third and fourth gears, attached to and rotating with a third shaft;

means for releasably engaging said first and second gears for rotation in unison; one rotation of said third gear producing a partial rotation of said first and second gears, whereby said first and second paper sheets are advanced;

means for translating said second gear out of engagement with said first gear and into alignment and releasable engagement with said fourth gear, one rotation of said fourth gear, when engaged to said second gear, producing rotation of said second gear exceeding the rotation produced by one rotation of said third gear; when said first and third gears are engaged and said second and fourth gears are engaged and third and fourth gears each make one rotation, said second paper sheet is advanced more than said first paper sheet is advanced; and control means for timing the translation of said second gear, said control means translating said second gear to oppose the untoothed major portion of said fourth gear during toothed engagement of said first and third gears, while said second gear is translated to engage for said rotation in unison when teeth of said first and third gears are disengaged, said first paper is fed and said second paper is stationary during a full rotation in unison of said third and fourth gears.

2. The paper feeding mechanism of claim 1, wherein said means for engaging said first and second gears include projections from the side face of one gear, said projections releasably engaging recesses in the opposed face of the other gear.

3. The paper feeding mechanism of claim 1, wherein said means for translating said second gear include a solenoid plunger.

4. The paper feeding mechanism of claim 1, wherein said third gear is turned one full rotation for at least one feeding of said first paper sheet.

* * * * *